US011118436B2

(12) United States Patent
Langford et al.

(10) Patent No.: US 11,118,436 B2
(45) Date of Patent: Sep. 14, 2021

(54) PRESSURE BULKHEAD

(71) Applicant: Hunting Titan, Inc., Pampa, TX (US)

(72) Inventors: Dale Langford, Pampa, TX (US); Rick Blain, Pampa, TX (US); Faraidoon Pundole, Sugar Land, TX (US); Gene McBride, Houston, TX (US); Joel Sansing, Wichita Falls, TX (US)

(73) Assignee: Hunting Titan, Inc., Pampa, TX (US)

( * ) Notice: Subject to any disclaimer, the term of this patent is extended or adjusted under 35 U.S.C. 154(b) by 62 days.

(21) Appl. No.: 16/611,607

(22) PCT Filed: May 18, 2018

(86) PCT No.: PCT/US2018/033509
§ 371 (c)(1),
(2) Date: Nov. 7, 2019

(87) PCT Pub. No.: WO2018/213782
PCT Pub. Date: Nov. 22, 2018

(65) Prior Publication Data

US 2020/0063537 A1 Feb. 27, 2020

Related U.S. Application Data

(60) Provisional application No. 62/508,831, filed on May 19, 2017.

(51) Int. Cl.
*E21B 43/1185* (2006.01)
*F42D 1/04* (2006.01)
(Continued)

(52) U.S. Cl.
CPC ..... *E21B 43/1185* (2013.01); *F42D 1/043* (2013.01); *F42D 1/05* (2013.01);
(Continued)

(58) Field of Classification Search
CPC .... E21B 43/1185; E21B 43/117; F42D 1/043; F42D 1/05; H01H 9/02; H01H 39/00
See application file for complete search history.

(56) References Cited

U.S. PATENT DOCUMENTS 5,912,431 A * 6/1999 Sheehan ..... H02G 3/0675 174/653
10,161,733 B2 * 12/2018 Eitschberger ..... H05K 5/0065
(Continued)

FOREIGN PATENT DOCUMENTS

GB 2544247 A 5/2017
WO 2018030996 A1 2/2015
WO 2015179787 A1 11/2015

OTHER PUBLICATIONS

Notification of Transmittal of the International Search Report and the Written Opinion of the International Searching Authority, PCT Application No. PCT/US18/33509, dated Aug. 23, 2018, 9 pages.
(Continued)

*Primary Examiner* — Nicole Coy
(74) *Attorney, Agent, or Firm* — Christopher McKeon; Jason Saunders; Arnold & Saunders, LLP

(57) ABSTRACT

A switch assembly adapted for electrically coupling perforating guns and providing improved safety.

47 Claims, 4 Drawing Sheets

(51) Int. Cl.

| | |
|---|---|
| ***F42D 1/05*** | (2006.01) |
| ***E21B 43/117*** | (2006.01) |
| ***H01H 9/02*** | (2006.01) |
| ***H01H 39/00*** | (2006.01) |

(52) U.S. Cl.
CPC ..... *E21B 43/117* (2013.01); *H01H 9/02* (2013.01); *H01H 39/00* (2013.01)

(56) References Cited

U.S. PATENT DOCUMENTS

| | | | | |
|---|---|---|---|---|
| 10,830,566 | B2 * | 11/2020 | Maxted | F42D 1/043 |
| 2013/0043074 | A1 | 2/2013 | Tassaroli | |
| 2013/0126237 | A1 * | 5/2013 | Burton | E21B 43/1185 175/2 |
| 2016/0245054 | A1 | 8/2016 | Hardesty et al. | |
| 2016/0245055 | A1 | 8/2016 | Hardesty et al. | |
| 2016/0273902 | A1 | 9/2016 | Eitschberger | |
| 2016/0356132 | A1 | 12/2016 | Burmeister et al. | |
| 2019/0162056 | A1 * | 5/2019 | Sansing | F41A 19/65 |
| 2019/0211655 | A1 * | 7/2019 | Bradley | E21B 17/042 |

OTHER PUBLICATIONS

Communication with Supplementary European Search Report in European Application No. EP18803115 dated Jan. 29, 2021, 5 pages.

* cited by examiner

PRESSURE BULKHEAD

RELATED APPLICATIONS

This application claims priority to U.S. Provisional Application No. 62/508,831, filed May 19, 2017.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

SUMMARY OF EXAMPLE EMBODIMENTS

An example embodiment may include an apparatus for electrically connecting a perforating gun having a housing having a first portion having a first end and a first outer diameter, and having a second portion with a second end and a second outer diameter, and an outer circumferential groove proximate to the second end, a switch disposed within the housing, and a retainer having a first end with a first bore with an inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially align.

An variation of the example embodiment may include the housing having a thru bore extending from the first end with a first inner diameter. It may include the housing having a switch bore extending from the second end with a second inner diameter, wherein the switch bore is adapted to house a switch. It may include the first outer diameter having a plurality of o-ring grooves. It may include a snap ring disposed within the outer circumferential groove of the housing and the inner circumferential groove of the retainer. It may include an explosively activated switch disposed within the second portion of the housing. It may include a first wire coupled to the switch and extending through the first end of the housing. It may include a second wire coupled to the switch and extending through the first end of the housing. The inner circumferential groove and the outer circumferential groove may be sized to fit a snap ring. The first outer diameter may be larger than the second outer diameter. The first bore of the retainer may have a diameter substantially equal to the diameter of the second outer diameter of the housing. The retainer may have a radial groove on the on the first end that abuts the second end of the housing when the retainer is installed to the housing. It may include a wave spring disposed within the radial groove, wherein the wave spring provides a longitudinal force pushing the retainer away from the housing. The switch is may be an addressable switch, a mechanical pressure switch, or a dual diode switch.

An example embodiment may include an apparatus for electrically connecting a perforating gun having a first perforating gun coupled to a tandem sub, a second perforating gun coupled to the tandem sub, and the tandem sub containing an switch bulkhead assembly further include a housing having a first portion having a first end and a first outer diameter, and having a second portion with a second end and a second outer diameter, an outer circumferential groove proximate to the second end, a thru bore extending from the first end with a first inner diameter, and a switch bore extending from the second end with a second inner diameter, a switch disposed within the switch bore of the second portion of the housing, a retainer having a first end with a first bore with a inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially align, and a snap ring disposed within the outer circumferential groove of the housing and the inner circumferential groove of the retainer.

A variation of an example embodiment may include the first outer diameter having a plurality of o-ring grooves. It may include a first wire coupled to the switch and extending through the first end of the housing. It may include a second wire coupled to the switch and extending through the first end of the housing. The inner circumferential groove and the outer circumferential groove may be sized to fit a snap ring. The first outer diameter may be larger than the second outer diameter. The first bore of the retainer may have a diameter substantially equal to the diameter of the second outer diameter of the housing. The retainer may have a radial groove on the on the first end that abuts the second end of the housing when the retainer is installed to the housing. It may include a wave spring disposed within the radial groove, wherein the wave spring provides a longitudinal force pushing the retainer away from the housing. The switch may be an addressable switch, a mechanical pressure switch, or a dual diode switch.

An example embodiment may include an electrically connecting a perforating gun comprising a housing having a first portion having a first end and a first outer diameter, and having a second portion with a second end and a second outer diameter, an outer circumferential groove proximate to the second end, a thru bore extending from the first end with a first inner diameter, and a switch bore extending from the second end with a second inner diameter, a switch disposed within the switch bore of the second portion of the housing, a retainer having a first end with a first bore with a inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially align, and a snap ring disposed within the outer circumferential groove of the housing and the inner circumferential groove of the retainer.

An example of an example embodiment may include a method for electrically coupling downhole tools comprising installing a switch into a housing, snapping a retainer fitting to the end of the housing, wherein the switch is retained longitudinally and is free to rotate, electrically coupling the wires from the switch to a tandem sub, coupling the housing to the tandem sub by threading the retainer fitting into the tandem sub, wherein the rotation of the retainer fitting does not cause the switch to rotate, coupling a first perforating gun with a tandem sub, and coupling a second perforating gun with the tandem sub to form a tool string.

A variation of the example embodiment may include lowering the tool string into a wellbore. It may include pulling up on the tool string while it is in the wellbore. It may include detonating the first perforating gun. It may include detonating the second perforating gun. The switch may be an addressable switch, a mechanical pressure switch, or a dual diode switch.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

Figure 1:
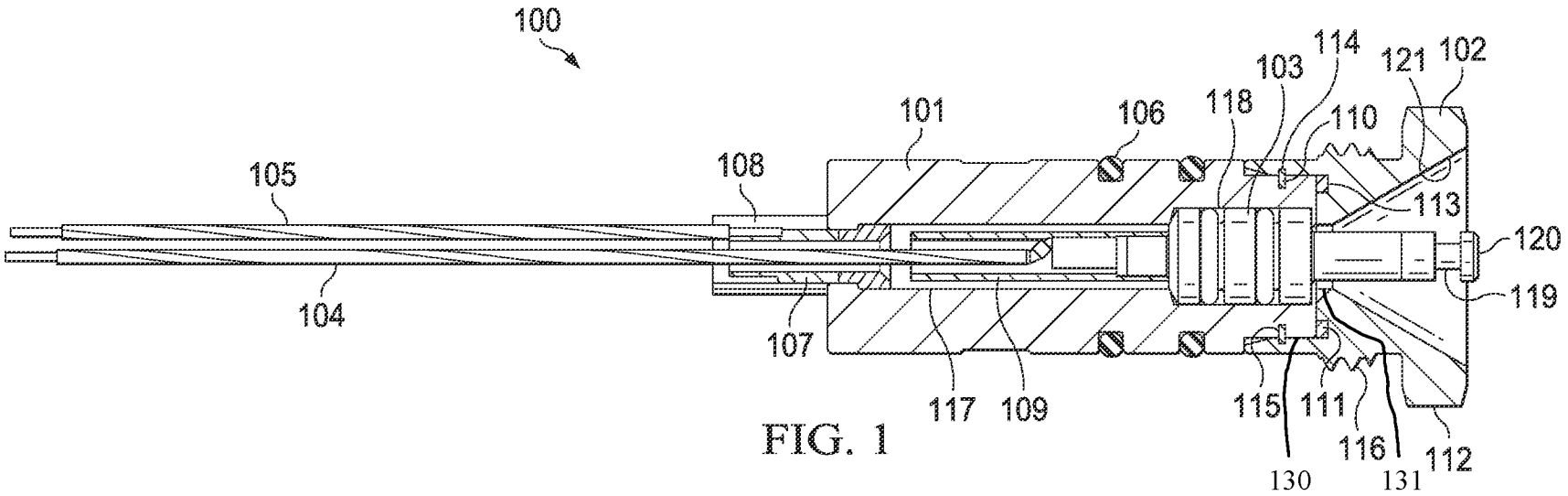
FIG. 1 shows a cross section of an example embodiment of a switch bulkhead.

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

The switch bulkhead assembly combines three existing products, a switch, a feed through bulkhead, and a retainer nut into a single part. This increases the efficiency of assembly of select fire perforating gun systems. A switch is used to fire individual perforating guns in the downhole well environment. Each tandem sub, located between perforating guns, may contain a switch, a detonator, and a bulkhead. The bulkhead is required to maintain a pressure seal between the perforating guns after each gun is fired from the downhole to uphole direction, or bottom up, exposing the fired gun to well pressure. The tandem sub is assembled with the switch, bulkhead and detonator in separate deliberate steps on location or at another location such as a gun loading shop. The switch bulkhead assembly integrates the switch, retainer nut, and the feed through bulkhead into one part, allowing the assembler to install both components in one step. The switch may be an addressable switch, a mechanical pressure switch, or a dual diode switch.

The switch bulkhead assembly may have two or three wires coming off of the body. The switch bulkhead assembly will be installed into the downhole end of the tandem sub using the hex head retainer nut which screws into the sub body. One wire, sometimes colored blue, from the switch bulkhead assembly is connected to the through wire or "shooting wire" from the above perforating gun. This wire connection can be made through the port of the tandem sub. When ready to arm, the detonator is connected to a second wire, sometimes green, of negative polarity and a third wire, sometimes red, of a positive polarity of the switch bulkhead assembly. These wire connections can be made through the port of the tandem sub. The detonator is then ballistically armed to the detonating cord.

The bulkhead switch assembly may be a combination retainer nut, bulkhead containing an electrical feed though. It may be a combination retainer nut and bulkhead containing a dual diode switch. It may be a combination retainer nut and bulkhead containing a mechanical pressure switch. It may be a combination retainer nut and bulkhead containing an addressable switch. It would be a bulkhead containing an addressable switch without a retainer nut.

An addressable switch typically has an associated microprocessor that can communicate with and/or be communicated with a surface control system. An addressable switch typically has a digital address associated with that particular switch. The addressable switch may be interrogated by the surface control system. When a gun string is assembled, the control system may map the switches and their associated guns. This allows for the control system to selectively arm and fire perforating guns when deployed downhole. The switches may be link to each other in series and then linked to the surface control system on a wireline system. The switches may use other means for identifying themselves to the surface control system. The switches provide a safety barrier between the electrical commands of the surface control system and the perforating guns. The addressable switches allow for skipping a gun that fails to function properly. The addressable switches prevent incorrect wiring or incorrect mapping of the guns at the surface because the surface control system and the addressable switches can map themselves through a series of interrogations and responses. Addressable switches allow for long gun strings to safely and efficiently perforate a multitude of selected areas in a formation.

FIG. 1 depicts an example embodiment of a switch bulkhead assembly 100. The assembly 100 contains a cylindrical body 101 with a hollow thru bore 117 and a switch bore 118 adapted to house a switch 103. A retainer 102 having threads 116, inner frusto-conical surface 121, and a hex head portion 112 is coupled to the body 101. Retainer 102 is held in place via retainer ring 110 located within the retainer inner ring groove 114 and the circumferential body retainer ring groove 115. Wave spring 111, disposed within the radial groove 113, provides a constant ground contact between the retainer 102 and the body 101. In this example embodiment both the retainer 102 and the body 101 are electrically conductive. The retainer ring 110 allows the retainer 102 to spin freely independent of the body 101 and overcome o-ring friction from o-rings 106 during the installation of the switch bulkhead assembly 100 into a perforating gun. The switch 103 may be an addressable switch, a mechanical pressure switch, or a dual diode switch. The retainer 102 has a first bore 130 and a thru bore 131 connecting the inner frusto-conical surface 121 with the first bore 130.

The retainer ring 110 is first placed into the body retainer ring groove 115. In this example the retainer ring 110 may be a snap ring with a gap. The retainer ring 110 compresses into the body retainer ring groove 115 while installing the retainer 102 over the retainer ring 110. The retainer ring 110 then snaps into place once it lines up with the retainer ring groove 114.

An insulating sleeve 109 is located within the thru bore 117 to electrically isolate the connection between the switch 103, wire 104, and the body 101. Grounding receptacle 107 is coupled to both the body 101 and the ground wire 105. Insulating sleeve 108 holds the wire 104 and ground wire 105 in place.

In one example, during operation a signal wire may be attached to the groove 119 on the plunger 120. In another example, a force may be applied to the plunger 120, usually due to explosive pressure or fluid pressure, causing the plunger to move into the switch 103, causing the switch to signal via wires 104 and 105 that a perforating gun has fired and then arm the next gun in a perforating gun string.

Figure 2:
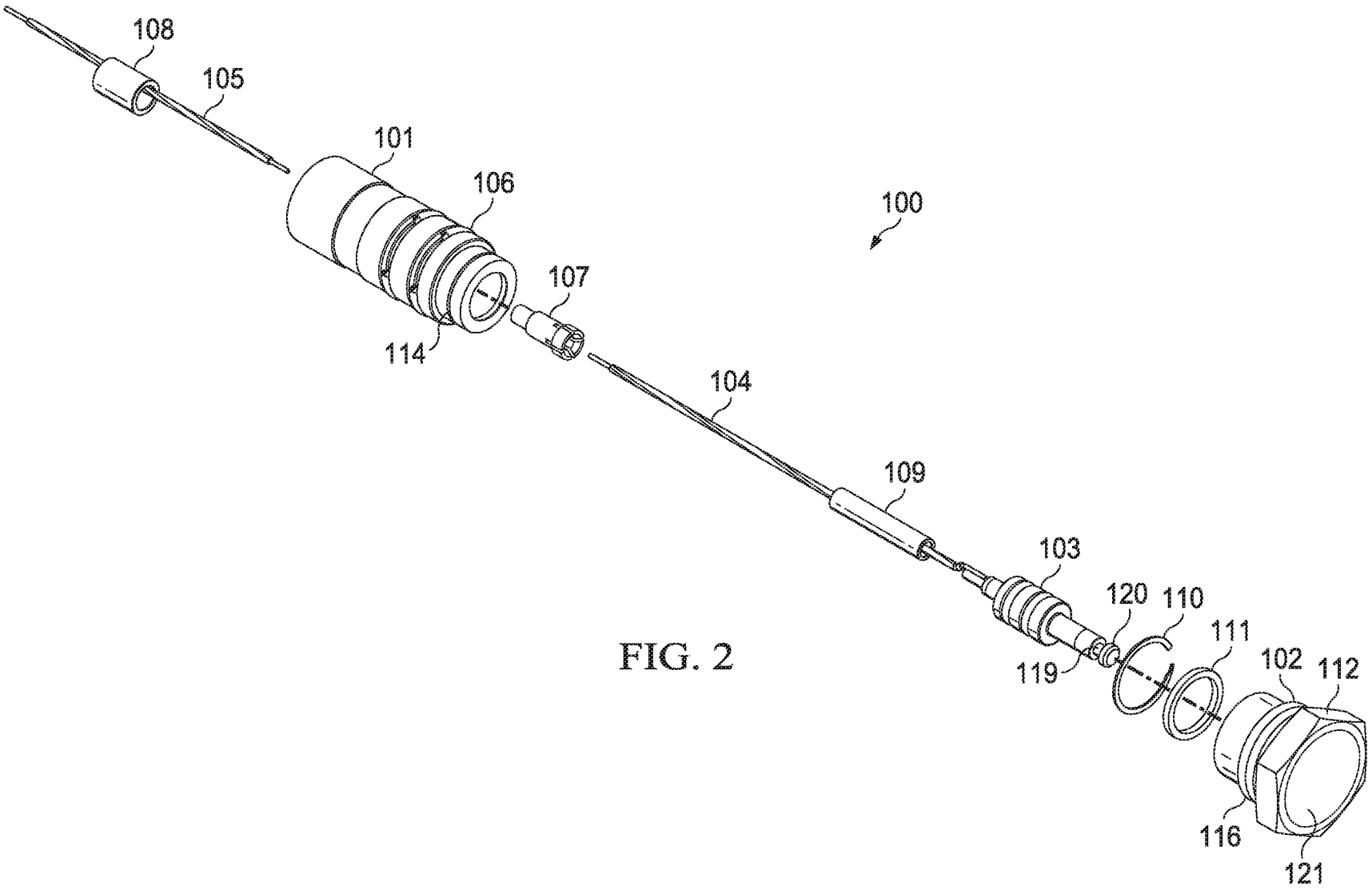
FIG. 2 shows an assembly view of the components within an example embodiment of a switch bulkhead.

FIG. 2 depicts an example embodiment of an exploded view of the switch bulkhead assembly 100. Wire 105 is coupled to grounding receptacle 107. Wire 104 is coupled to the switch 103. Switch 103 is located within cylindrical body 101. Retainer 102 is coupled to the body 101 and held in place with retainer ring 110 located within the retainer ring groove 114. Wave spring 111 provides a constant ground contact between the retainer 102 and the body 101. The plunger 120 is integral to the switch 103 and has a circumferential groove 119 to contact to a signal wire. Hex head portion 112 has faces for a tool to screw the retainer 102 into a tandem sub using threads 116. Retainer 102 has an inner frusto-conical surface 121. Cylindrical body 101, which acts as a housing containing the switch 103, has o-rings to seal it within a tandem sub. Insulating sleeve 109 is used to electrically isolate the connection between the switch 103, wire 104, and the body 101. Insulating sleeve 108 holds the wire 104 and ground wire 105 in place. The switch 103 may be an addressable switch, a mechanical pressure switch, or a dual diode switch.

Figure 3:
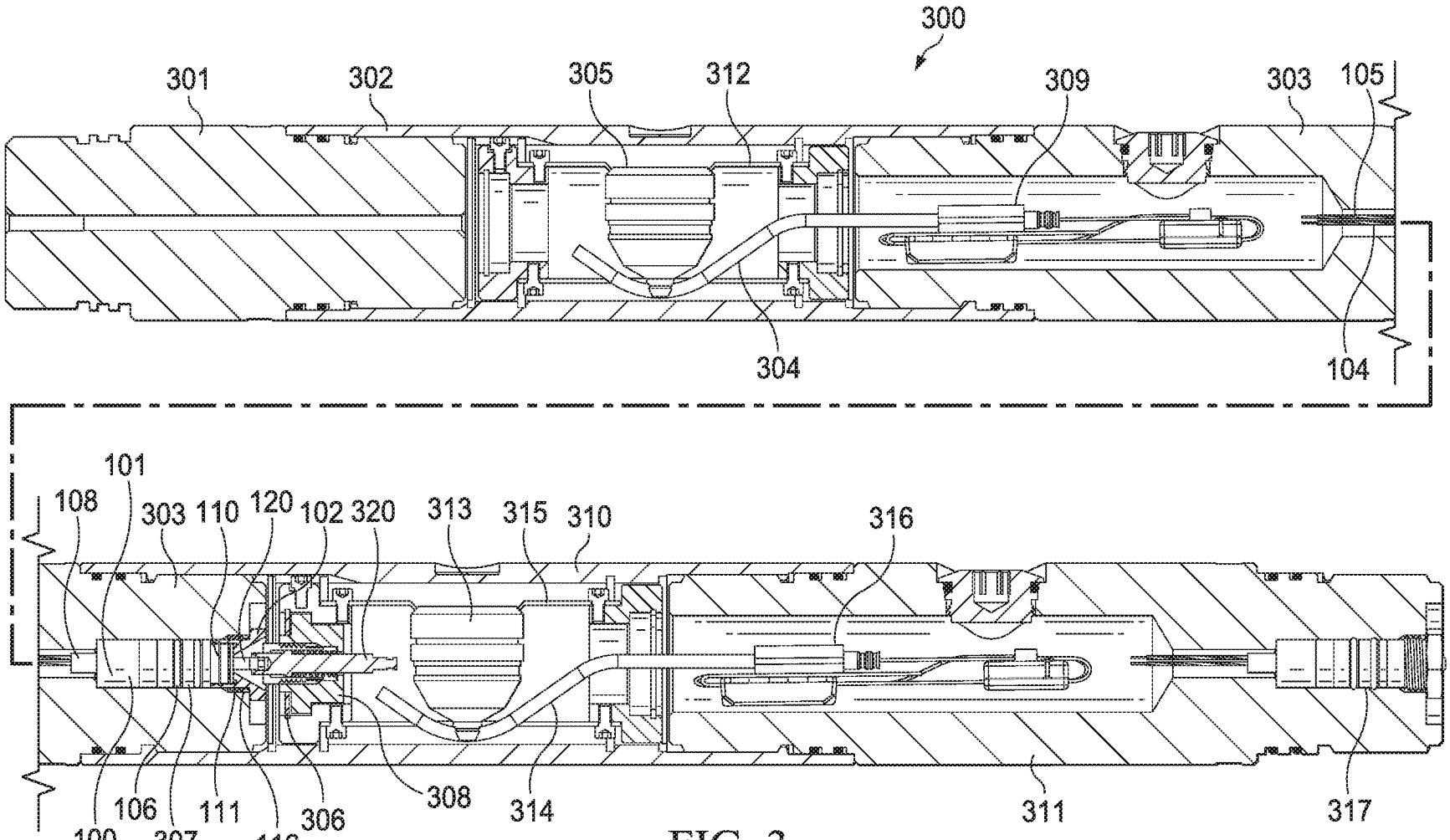
FIG. 3 shows a side cross sectional view of an example embodiment of a downhole perforating gun assembly containing a switch bulkhead.

FIG. 3 depicts an example embodiment of a perforating gun assembly 300. The perforating gun assembly 300 includes a top sub 301 located at the uphole end of the perforating gun assembly 300. A first perforating gun 302 is coupled to, and located downhole from, the top sub 301. A first tandem sub 303 is coupled to, and located downhole from, the perforating gun 302. A second perforating gun 310 is coupled to, and located downhole from, the tandem sub 303. A second tandem sub 311 is coupled to, and located downhole from, the perforating gun 310. The switch 103 may be an addressable switch, a mechanical pressure switch, or a dual diode switch.

Perforating gun 302 contained a shaped charge 305 located in a charge tube 312. The detonating cord 304 is coupled to the apex end of the shaped charge 305. A switch 309 is located in the tandem sub 303 and is coupled to the detonating cord 304. The control fire switch 309 is electrically coupled to the feed thru bulkhead 307 located within the tandem sub 303.

The switch bulkhead assembly 100 includes a retainer 102 that is coupled to the tandem sub 303 using threads 116. The plunger 120 is coupled to a spring loaded pin 320 disposed within the end fitting 308, which is held into place using retainer 306.

Perforating gun 310 includes a shaped charge 313 within a charge tube 315 and a detonating cord 314 coupled to the apex end of the shaped charge 313. Detonating cord 314 is coupled to the switch 316. The switch 316 is electrically connected to feed thru bulkhead 317 located within the tandem sub 311.

When the feed thru bulkhead is installed into tandem sub 303, the wires 104 and 105 are wired to the switch 309, then the feed thru bulkhead 307 is threaded into place using retainer 102 and threads 116. Since the retainer 102 can spin freely with respect to the body 101 due to retainer ring 110, the feed thru bulkhead 307 can be tightened down without inadvertently twisting wires 104 and 105. The body 101 will be held relatively at the same orientation during installation of the retainer 102 because of the o-ring 106 friction. Insulating sleeve 108 holds the wire 104 and ground wire 105 in place. Wave spring 111 provides a constant ground contact between the retainer 102 and the body 101.

During operation the detonation by switch 316 of detonating cord 314 will cause the shaped charge 313 to fire. The pressure generated in perforating gun 310 will also impact spring loaded pin 320 to push against plunger 120, closing the switch located within feed thru bulkhead 307. Closing feed thru bulkhead 307 will arm switch 309.

Figure 4:
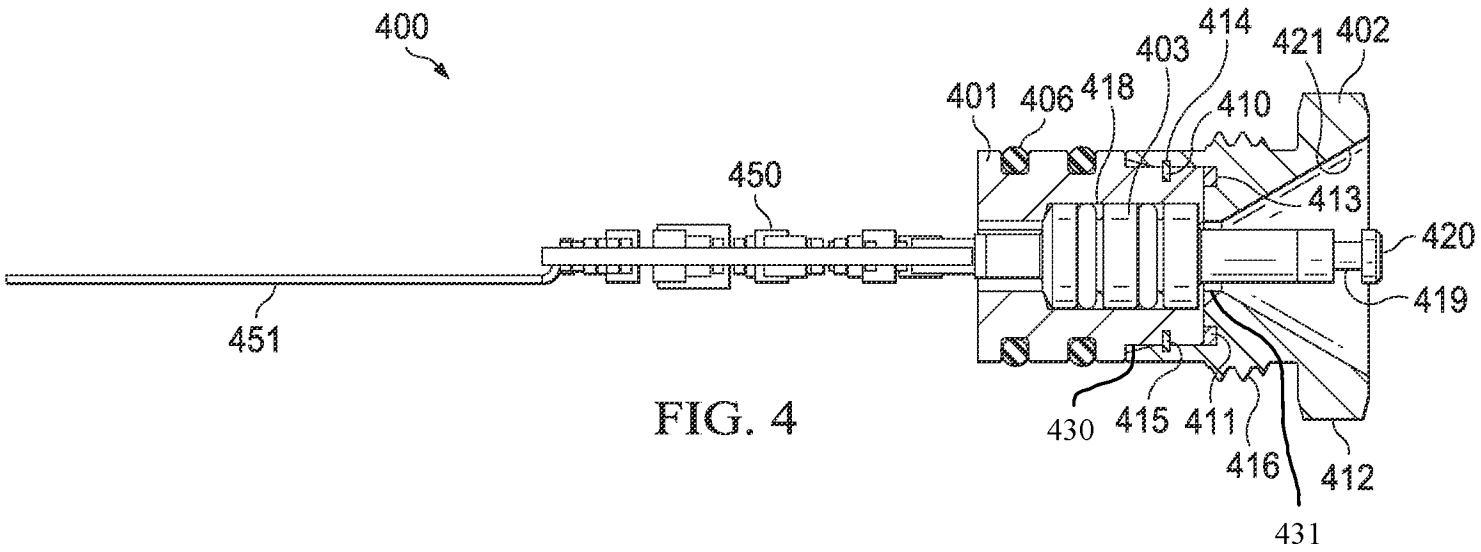
FIG. 4 shows a cross section of an example embodiment of a switch bulkhead.

FIG. 4 depicts an example embodiment of a switch bulkhead assembly 400. The assembly 400 contains a cylindrical body 401 with a switch bore 418 adapted to house a switch 403. A retainer 402 having threads 416, inner frusto-conical surface 421, and a hex head portion 412 is coupled to the body 401. Retainer 402 is held in place via retainer ring 410 located within the retainer inner ring groove 414 and the circumferential body retainer ring groove 415. Wave spring 411, disposed within the radial groove 413, provides a constant ground contact between the retainer 402 and the body 401. In this example embodiment both the retainer 402 and the body 401 are electrically conductive. The retainer ring 410 allows the retainer 402 to spin freely independent of the body 401 and overcome o-ring friction from o-rings 406 during the installation of the switch bulkhead assembly 400 into a perforating gun. The switch 403 may be an addressable switch, a mechanical pressure switch, or a dual diode switch. A circuit board 450 is electrically connected to the switch 403. The circuit board 450 may include a microprocessor. The circuit board 450 has wires 451 extending from the distal end of the circuit board 450. The wires 450 may be three wires. The wires 450 may include a negative polarity wire, a positive polarity wire, and a ground wire. The circuit board 450 may be integral with switch 403 and may collectively be referred to as the switch. The retainer 402 has a first bore 430 and a thru bore 431 connecting the inner frusto-conical surface 421 with the first bore 430.

The retainer ring 410 is first placed into the body retainer ring groove 415. In this example the retainer ring 410 may be a snap ring with a gap. The retainer ring 410 compresses into the body retainer ring groove 415 while installing the retainer 402 over the retainer ring 410. The retainer ring 410 then snaps into place once it lines up with the retainer ring groove 414.

In one example, during operation a signal wire may be attached to the groove 419 on the plunger 420. In another example, a force may be applied to the plunger 420, usually due to explosive pressure or fluid pressure, causing the plunger to move into the switch 403, signaling that a perforating gun has fired and arming the next gun in a perforating gun string.

Figure 5:
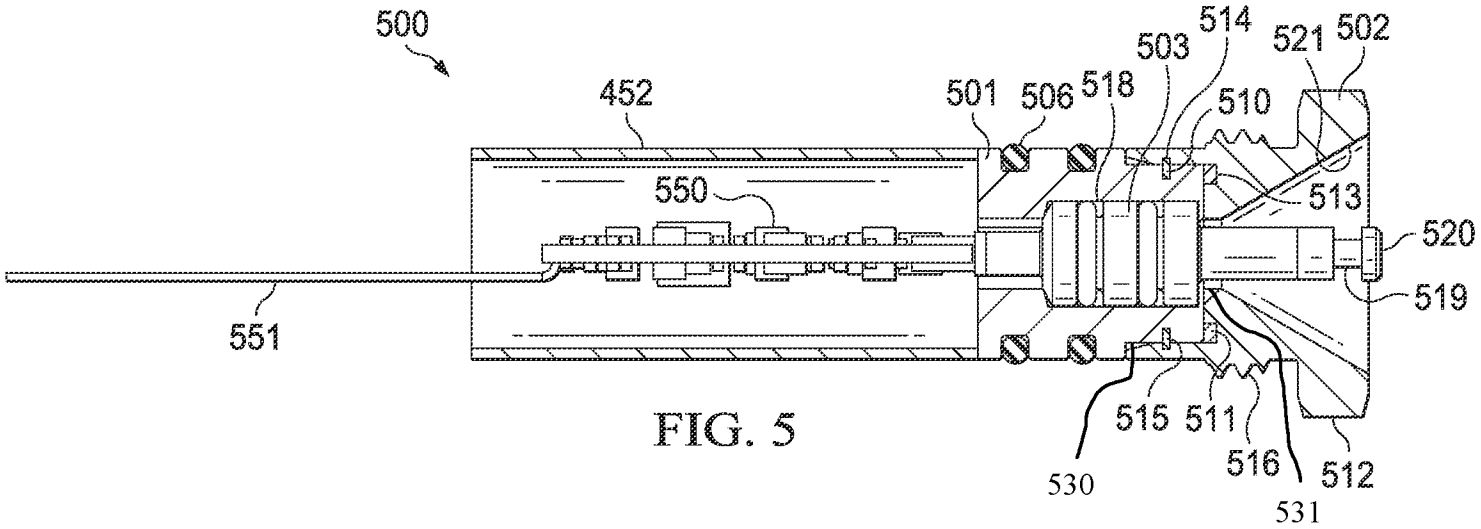
FIG. 5 shows a cross section of an example embodiment of a switch bulkhead.

FIG. 5 depicts an example embodiment of a switch bulkhead assembly 500. The assembly 500 contains a cylindrical body 501 with a switch bore 518 adapted to house a switch 503. A retainer 502 having threads 516, inner frusto-conical surface 521, and a hex head portion 512 is coupled to the body 501. Retainer 502 is held in place via retainer ring 510 located within the retainer inner ring groove 514 and the circumferential body retainer ring groove 515. Wave spring 511, disposed within the radial groove 513, provides a constant ground contact between the retainer 502 and the body 501. In this example embodiment both the retainer 502 and the body 501 are electrically conductive. The retainer ring 510 allows the retainer 502 to spin freely independent of the body 501 and overcome o-ring friction from o-rings 506 during the installation of the switch bulkhead assembly 500 into a perforating gun. A circuit board 550 is electrically connected to the switch 503. The circuit board 550 may be integral with switch 503 and may collectively be referred to as the switch. The circuit board 550 may include a microprocessor. The circuit board 550 has wires 551 extending from the distal end of the circuit board 550. The wires 550 may be three wires.

The wires 550 may include a negative polarity wire, a positive polarity wire, and a ground wire. Body 501 is coupled to, or integral with, switch shield 452 that protects circuit board 550. The switch 503 may be an addressable switch, a mechanical pressure switch, or a dual diode switch. The retainer 502 has a first bore 530 and a thru bore 531 connecting the inner frusto-conical surface 521 with the first bore 530.

The retainer ring 510 is first placed into the body retainer ring groove 515. In this example the retainer ring 510 may be a snap ring with a gap. The retainer ring 510 compresses into the body retainer ring groove 515 while installing the retainer 502 over the retainer ring 510. The retainer ring 510 then snaps into place once it lines up with the retainer ring groove 514.

In one example, during operation a signal wire may be attached to the groove 519 on the plunger 520. In another example, a force may be applied to the plunger 520, usually due to explosive pressure or fluid pressure, causing the plunger to move into the switch 503, signaling that a perforating gun has fired and arming the next gun in a perforating gun string.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for electrically connecting a perforating gun comprising:

a housing having a first portion having a first end and a first outer diameter, and having a second portion with a second end and a second outer diameter, and an outer circumferential groove proximate to the second end;

a switch disposed within the housing;

a retainer having a first end with a first bore with an inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially aligns with the outer circumferential groove of the housing; and a snap ring disposed within the outer circumferential groove of the housing and the inner circumferential groove of the retainer.

2. The apparatus of claim 1 further comprising the housing having a thru bore extending from the first end with a first inner diameter.

3. The apparatus of claim 1 further comprising the housing having a switch bore extending from the second end with a second inner diameter, wherein the switch bore is adapted to house the switch.

4. The apparatus of claim 1 further comprising the first outer diameter having a plurality of o-ring grooves.

5. The apparatus of claim 1 further comprising an explosively activated switch disposed within the second portion of the housing.

6. The apparatus of claim 1 further comprising a first wire coupled to the switch and extending through the first end of the housing.

7. The apparatus of claim 1 further comprising a second wire coupled to the switch and extending through the first end of the housing.

8. The apparatus of claim 1, wherein the inner circumferential groove and the outer circumferential groove are sized to fit a snap ring.

9. The apparatus of claim 1 wherein the first outer diameter is larger than the second outer diameter.

10. The apparatus of claim 1, wherein the first bore of the retainer has a diameter substantially equal to the diameter of the second outer diameter of the housing.

11. The apparatus of claim 1 further comprising the retainer having a radial groove on the on the first end that abuts the second end of the housing when the retainer is installed to the housing.

12. The apparatus of claim 11 further comprising a wave spring disposed within the radial groove, wherein the wave spring provides a longitudinal force pushing the retainer away from the housing.

13. The apparatus of claim 1 wherein the switch is an addressable switch.

14. The apparatus of claim 1 wherein the switch is a mechanical pressure switch.

15. The apparatus of claim 1 wherein the switch is a dual diode switch.

16. An apparatus for electrically connecting a perforating gun comprising:

a first perforating gun coupled to a tandem sub;

a second perforating gun coupled to the tandem sub; and the tandem sub containing a switch bulkhead assembly further comprising:

a housing having a first portion having a first end and a first outer diameter, and having a second portion with a second end and a second outer diameter, an outer circumferential groove proximate to the second end, a thru bore extending from the first end with a first inner diameter, and a switch bore extending from the second end with a second inner diameter;

a switch disposed within the switch bore of the second portion of the housing;

a retainer having a first end with a first bore with a inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially aligns with the outer circumferential groove of the housing; and a snap ring disposed within the outer circumferential groove of the housing and the inner circumferential groove of the retainer.

17. The apparatus of claim 16 further comprising the first outer diameter having a plurality of o-ring grooves.

18. The apparatus of claim 16 further comprising a first wire coupled to the switch and extending through the first end of the housing.

19. The apparatus of claim 16 further comprising a second wire coupled to the switch and extending through the first end of the housing.

20. The apparatus of claim 16 wherein the inner circumferential groove and the outer circumferential groove are sized to fit a snap ring.

21. The apparatus of claim 16 wherein the first outer diameter is larger than the second outer diameter.

22. The apparatus of claim 16 wherein the first bore of the retainer has a diameter substantially equal to the diameter of the second outer diameter of the housing.

23. The apparatus of claim 16 further comprising the retainer having a radial groove on the on the first end that abuts the second end of the housing when the retainer is installed to the housing.

24. The apparatus of claim 23 further comprising a wave spring disposed within the radial groove, wherein the wave spring provides a longitudinal force pushing the retainer away from the housing.

25. The apparatus of claim 16 wherein the switch is an addressable switch.

26. The apparatus of claim 16 wherein the switch is a mechanical pressure switch.

27. The apparatus of claim 16 wherein the switch is a dual diode switch.

28. An apparatus for electrically connecting a perforating gun comprising:

a housing having a first portion having a first end and a first outer diameter, and having a second portion with a second end and a second outer diameter, an outer circumferential groove proximate to the second end, a thru bore extending from the first end with a first inner diameter, and a switch bore extending from the second end with a second inner diameter;

a switch disposed within the switch bore of the second portion of the housing;

a retainer having a first end with a first bore with a inner circumferential groove proximate to the first end, a second end with a frusto conical shaped bore, a thru bore connecting the first bore with the frusto conical shaped bore, wherein the first bore is coupled to the second end of the housing and the inner circumferential groove of the retainer substantially aligns with the outer circumferential groove of the housing; and a snap ring disposed within the outer circumferential groove of the housing and the inner circumferential groove of the retainer.

29. The apparatus of claim 28 further comprising the first outer diameter having a plurality of o-ring grooves.

30. The apparatus of claim 28 further comprising a first wire coupled to the switch and extending through the first end of the housing.

31. The apparatus of claim 28 further comprising a second wire coupled to the switch and extending through the first end of the housing.

32. The apparatus of claim 28 wherein the inner circumferential groove and the outer circumferential groove are sized to fit a snap ring.

33. The apparatus of claim 28 wherein the first outer diameter is larger than the second outer diameter.

34. The apparatus of claim 28 wherein the first bore of the retainer has a diameter substantially equal to the diameter of the second outer diameter of the housing.

35. The apparatus of claim 28 further comprising the retainer having a radial groove on the on the first end that abuts the second end of the housing when the retainer is installed to the housing.

36. The apparatus of claim 35 further comprising a wave spring disposed within the radial groove, wherein the wave spring provides a longitudinal force pushing the retainer away from the housing.

37. The apparatus of claim 28 wherein the switch is an addressable switch.

38. The apparatus of claim 28 wherein the switch is a mechanical pressure switch.

39. The apparatus of claim 28 wherein the switch is a dual diode switch.

40. A method for electrically coupling downhole tools comprising:

installing a switch into a housing;

snapping a retainer fitting to the end of the housing, wherein the switch is retained longitudinally and is free to rotate;

electrically coupling the wires from the switch to a tandem sub;

coupling the housing to the tandem sub by threading the retainer fitting into the tandem sub, wherein the rotation of the retainer fitting does not cause the switch to rotate;

coupling a first perforating gun with a tandem sub; and coupling a second perforating gun with the tandem sub to form a tool string.

41. The method of claim 40 further comprising lowering the tool string into a wellbore.

42. The method of claim 40 further comprising pulling up on the tool string while it is in the wellbore.

43. The method of claim 40 further comprising detonating the first perforating gun.

44. The method of claim 43 further comprising detonating the second perforating gun.

45. The method of claim 40 wherein the switch is an addressable switch.

46. The method of claim 40 wherein the switch is a mechanical pressure switch.

47. The method of claim 40 wherein the switch is a dual diode switch.

* * * * *